US006140278A

United States Patent [19]

Thomas et al.

[11] Patent Number: 6,140,278

[45] Date of Patent: Oct. 31, 2000

[54] LUBRICATED FERROUS POWDER COMPOSITIONS FOR COLD AND WARM PRESSING APPLICATIONS

[75] Inventors: Yannig Thomas, Montreal; Sylvain Pelletier, Ste Julie; Sylvain St-Laurent, Repentigny; Linda Tremblay, Ste Julie, all of Canada

[73] Assignee: National Research Council of Canada, Ottowa, Canada

[21] Appl. No.: 09/186,196

[22] Filed: Nov. 4, 1998

[51] Int. Cl.[7] ..... C10M 111/04

[52] U.S. Cl. ..... 508/150; 106/270; 106/271; 106/272

[58] Field of Search ..... 508/150; 106/270, 106/271, 272

[56] References Cited

U.S. PATENT DOCUMENTS

| | | | |
|---|---|---|---|
| 3,691,130 | 9/1972 | Logvinenko | 241/1 |
| 4,239,632 | 12/1980 | Baile | 508/150 |
| 4,946,499 | 8/1990 | Sakuranda et al. | 427/217 |
| 5,055,128 | 10/1991 | Kiyoto et al. | 419/36 |
| 5,154,881 | 10/1992 | Rutz | 419/36 |
| 5,429,792 | 7/1995 | Luk | 419/36 |
| 5,523,006 | 6/1996 | Strumban | 508/150 |
| 5,554,338 | 9/1996 | Sugihara et al. | 419/36 |
| 5,663,124 | 9/1997 | Rao et al. | 508/150 |
| 5,863,870 | 1/1999 | Rao et al. | 508/150 |

FOREIGN PATENT DOCUMENTS

| | | |
|---|---|---|
| 58-223662A | 12/1983 | Japan . |
| 62-048747A | 3/1987 | Japan . |
| 62-208608A | 9/1987 | Japan . |
| WO99/11406 | 3/1999 | Sweden . |
| WO99/28067 | 6/1999 | Sweden . |
| WO99/20689 | 4/1999 | WIPO . |

OTHER PUBLICATIONS

Shamrock Technologies, Technical Data, Ceracer 640 (1994).

Shamrock Technologies, Technical Data, Ceracer Waxes (no date).

J. Auborn et al., Mechanisms of Lubrication . . . Adv. In Powder metall & Particulate Mater., vol. 2, 17–25 (1993).

J. Auborn et al., Effect of Chemistry . . . , Adv. In Powder Metall. & Particulate Materials, vol. 3, 103, 1994.

U. Klemm et al., evaluation of New Types of Lubricants . . . Adv. In Powder Metall. & Particulate Mater., vol. 2, p. 51 (1993).

*Primary Examiner*—Jacqueline V. Howard
*Attorney, Agent, or Firm*—Julivsz Szercizewski

[57] ABSTRACT

Metal powder compositions for powder metallurgy (P/M) applications contain a high-density polyethylene as a lubricant. The compositions are suitable for either cold or warm compaction. When compacted, the compositions yield parts having relatively high density, high green strength and good surface finish.

8 Claims, 4 Drawing Sheets

Linear
Polyethylene

Ramified
Polyethylene

LUBRICATED FERROUS POWDER COMPOSITIONS FOR COLD AND WARM PRESSING APPLICATIONS

FIELD OF THE INVENTION

The present invention relates to metal powder compositions for powder metallurgy (P/M) applications containing a lubricant effective for either cold or warm compaction. The invention also relates to a method of fabricating pressed and sintered parts from such compositions by cold or warm compaction. More particularly, the invention concerns lubricated powder compositions which, when compacted, yield parts having relatively high density, high green strength and good surface finish.

BACKGROUND OF THE INVENTION

Processes for producing metal parts from ferrous powders using powder metallurgy (P/M) techniques are well known. Such techniques typically involve mixing of ferrous powders with alloying components such as graphite, copper or nickel in powder form, filling the die with the powder mixture, compacting and shaping of the compact by the application of pressure, and ejecting the compact from the die. The compact is then sintered wherein metallurgical bonds are developed by mass transfer under the influence of heat. The presence of an alloying element enhances the strength and other mechanical properties in the sintered part compared to the ferrous powders alone. When necessary, secondary operations such as sizing, coining, repressing, impregnation, infiltration, machining, joining, etc. are performed on the P/M part.

It is common practice to use a lubricant for the compaction of ferrous powders. It is required mainly to reduce the friction between metal powders and die walls. By ensuring a good transfer of the compacting force during the compaction stage, it improves the uniformity of densification throughout the part. Besides, it also lowers the force required to remove the compact from the die, thus minimizing die wear and yielding parts with good surface finish.

The lubricant can be admixed with the ferrous powders or sprayed onto the die walls before the compaction. Die-wall lubrication is known to give rise to compacts with high green strength. Indeed, die-wall lubrication enables mechanical anchoring and metallurgical bonding between particles during compaction. However, die-wall lubrication increases the compaction cycle time, leads to less uniform densification and is not applicable to complex shapes. Therefore, in practice, the lubricant is most often admixed to the ferrous powders. The amount of lubricant is function of the application. Its content should be sufficient to minimize the friction forces at the die walls during the compaction and ejection of the parts. The amount of lubricant should, however, be kept as low as possible in the case of applications requiring high density level.

On the other hand, admixed lubricant most often reduces the strength of the green compact by forming a lubricant film between the metal particles which limits microwelding. When complex parts or parts with thin walls are to be produced, as well as when green parts have to be machined, parts with a high green strength are required. There is thus a need for a lubricant that would enable the manufacture of high green strength parts.

While cold compaction (at room temperature or rather 50–70° C. in industrial conditions) is used most often, warm compaction (at temperatures up to 150° C.–180° C.) is also used when parts with high density are required. Indeed, warm compaction takes advantage of the fact that a moderate increase in the temperature of compaction lowers the yield strength of iron and steel particles and increases their malleability, leading to an increase of density for a given applied pressure.

However, the temperature used in warm compaction may affect the properties of the admixed lubricant and therefore affect the lubrication behavior during the compaction and ejection stages. Effectively, most of lubricants that are suitable for cold compaction cannot be used for warm compaction as this would cause increased die wear and produce parts with bad surface finish.

Conventional lubricants used in cold compaction include metallic stearates as zinc stearate or lithium stearate, or synthetic amide waxes as N,N'-ethylenebis(stearamide) or mixtures of metallic stearates and/or synthetic amide waxes. Polyethylene waxes, like CERACER 640, commercially available from Shamrock Technologies, have also been suggested as lubricants for cold compaction, but little literature exists on the use of this type of lubricant. Like synthetic amide waxes, polyethylene waxes have the advantage to decompose cleanly so that compacted parts are left free from residuals after the sintering operation. Shamrock Technologies report the use of their polyethylene wax lubricants to improve the green strength of metallic or ceramic bodies. On the other hand, Klemm et al., Adv.Powder Metall. & Particulate Matter., Vol. 2, 51–61 (1993), report in a study evaluating various P/M lubricants that the polyethylene wax tested lead to such a bad lubrication during the ejection of parts (high level of stick-slip), that they had to reject the idea to use this type of lubricant.

Accordingly, there is a need for an improved lubricant that would afford excellent lubrication in the course of both cold compaction and warm compaction of ferrous powders, and would enable the manufacture of parts having high green strength by cold compaction and having significantly higher density and green strength by warm compaction.

SUMMARY OF THE INVENTION

It is an object of this invention to provide ferrous powder compositions for the fabrication of ferrous-based powder compacts comprising a solid lubricant effective either for cold or warm compaction.

It is another object of the invention to provide lubricated ferrous powder compositions which when formed by P/M warm compaction techniques give parts with a high density and a high green strength and which can be ejected from the die cavity with relatively low ejection forces.

In accordance with the invention, there is provided a metal powder composition comprising a metal powder and from about 0.1 to about 3 wt % of a high-density polyethylene lubricant based on the total weight of the composition, preferably from about 0.2 wt. % to about 1.5 wt. %. The polyethylene lubricant may be admixed to the metal powder in a solid state (comminuted, usually as a powder), in emulsion, in solution or in the melted state.

Typically, the metal powder is an iron-based powder. Examples of iron-based powder are pure iron powders, powders of iron pre-alloyed with other elements, and powders of iron to which such other elements have been diffusion-bonded. The composition may further contain powders of such alloying elements in the amount of up to 15 wt. % of said composition. Examples of alloying elements include, but are not limited to, elemental copper, nickel, molybdenum, manganese, phosphorous, metallurgical carbon (graphite) and ferro-alloys.

Typically, the improved polyethylene lubricant of the invention is a linear high-density polyethylene which has a weight-average molecular weight MW between 2,000 and 50,000, preferably between 5,000 and 20,000, and which has a sharp melting point, determined from differential scanning calorimetry, between 120 and 140° C., preferably between 130 and 140° C. The polyethylene lubricant of the invention includes both regular high-density polyethylene having typically a density of 0.95–0.97 g/cc and slightly oxidized high density polyethylene having typically a density of 0.98–1.00 g/cc and an acid number up to 100 mg KOH/g. The polyethylene lubricant described in this invention is different from the low-molecular-weight branched-polyethylene waxes used thus far, which have a broad melting temperature ranging mainly between 60 and 120° C.

The composition may further comprise other solid lubricants or binders to optimize the flow or produce segregation-free mixes.

The metal powder compositions of the invention can be compacted into parts in a die and subsequently sintered according to standard powder metallurgy techniques.

BRIEF DESCRIPTION OF THE DRAWINGS

The invention will be explained in more detail by way of the following disclosure to be taken in conjunction with the drawings, in which.

DETAILED DESCRIPTION OF THE INVENTION

In accordance with the present invention, polyethylene-lubricated powder compositions suitable for the fabrication of ferrous compacts for P/M applications were prepared and tested. Exemplary metal powders suitable for the purpose of the present invention are any of iron-based powders used in the P/M industry, such as pure iron powders, pre-alloyed iron powders (including steel powders) and diffusion-bonded iron-based powders. Essentially any ferrous powder having a maximum particle size less than about 600 microns can be used in the composition of the invention. Typical ferrous powders are iron and steel powders including stainless steel and alloyed steel powders. ATOMET® steel powders manufactured by Quebec Metal Powders Limited of Tracy, Quebec, Canada are representative of such iron and steel powders. These ATOMET® powders contain in excess of 97 weight percent iron, less than 0.3 weight percent oxygen and less than 0.1 weight percent carbon, and have an apparent density of 2.50 g/cm$^3$ or higher and a flow rate of less than 30 seconds per 50 g. Virtually any grade of iron and steel powders can be used.

Optionally, the iron-based powders can be admixed with alloying powders in the amount of less than 15 weight percent. Examples of alloying powders include, but are not limited to, elemental copper, nickel, molybdenum, manganese, phosphorous, metallurgical carbon (graphite) and ferro-alloys.

The powder composition of the invention includes a comminuted high-density polyethylene lubricant in an amount from about 0.1 to about 3 wt % based on the total weight of the composition, preferably from about 0.2 wt. % to about 1.5 wt. %. This lubricant may be admixed in the solid state or in emulsion. It can also be admixed in solution or in the melted state when agglomeration of powders or binding effect of the additives to ferrous powders are desired to improve either the flowability and/or to reduce segregation and dusting of the powder compositions. The admixture may be carried out in a single operation or step, or in several steps. The average particle size of the lubricant is in the range of 1–150 $\mu$m, but preferably below 75 $\mu$m and more preferably below 45 $\mu$m. The polyethylene lubricant may be the only lubricant or additional lubricants, as for example lithium 12-hydroxy stearate, may be used (admixed or sprayed into die cavities or punches) to improve lubrication or the flowability of the powder compositions. Additionally, binders, as for example polyvinylpyrrolidone, may be used to improve the flowability and/or to reduce segregation and dusting of the powder compositions.

Figure 1:
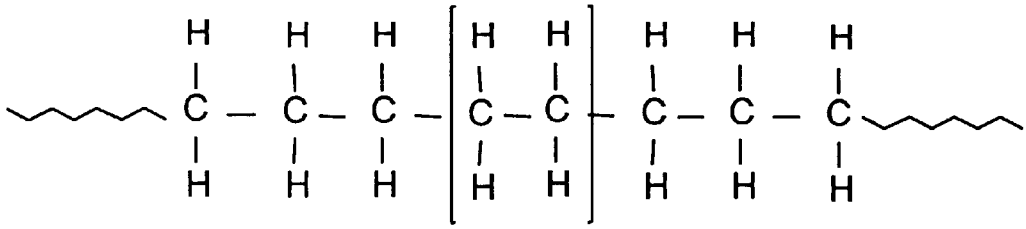
FIG. 1 illustrates the difference between linear and ramified (branched) polyethylene.
Figure 1:
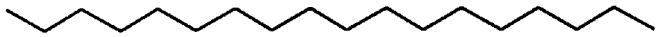
Figure 1:
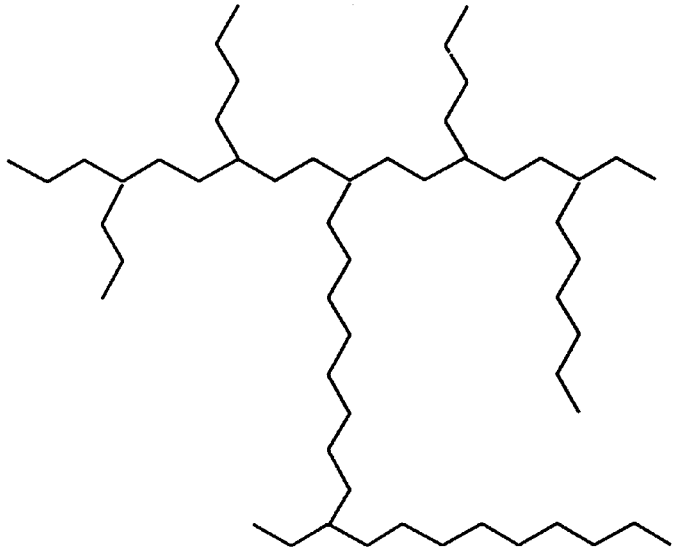
Figure 2A:
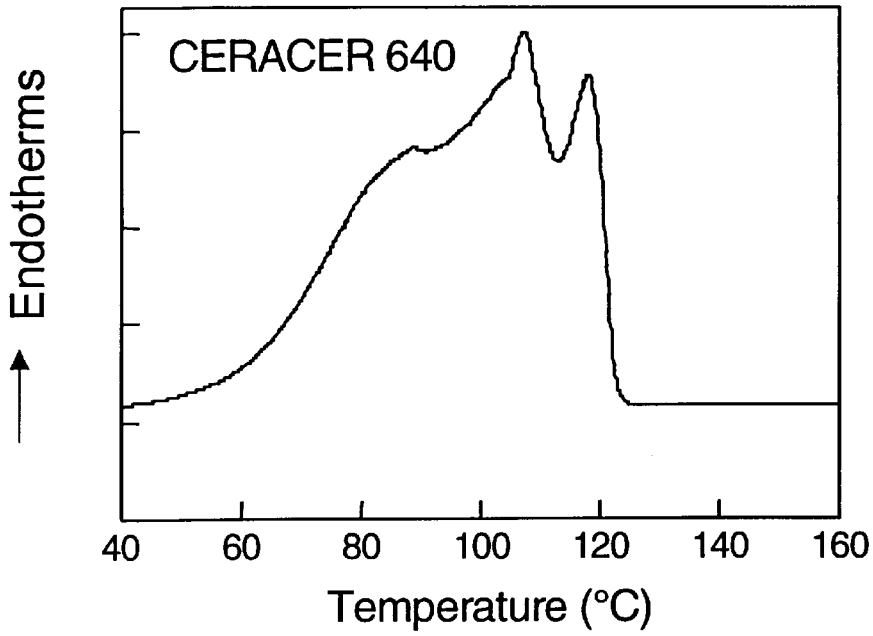
FIGS. 2*a* and 2*b* are Differential Scanning Calorimetry (DSC) thermograms (10 deg.C/min) of CERACER 640, a low density and low MW ramified polyethylene wax, and of ACumist A-12, slightly oxidized high density polyethylene, respectively.
Figure 2B:
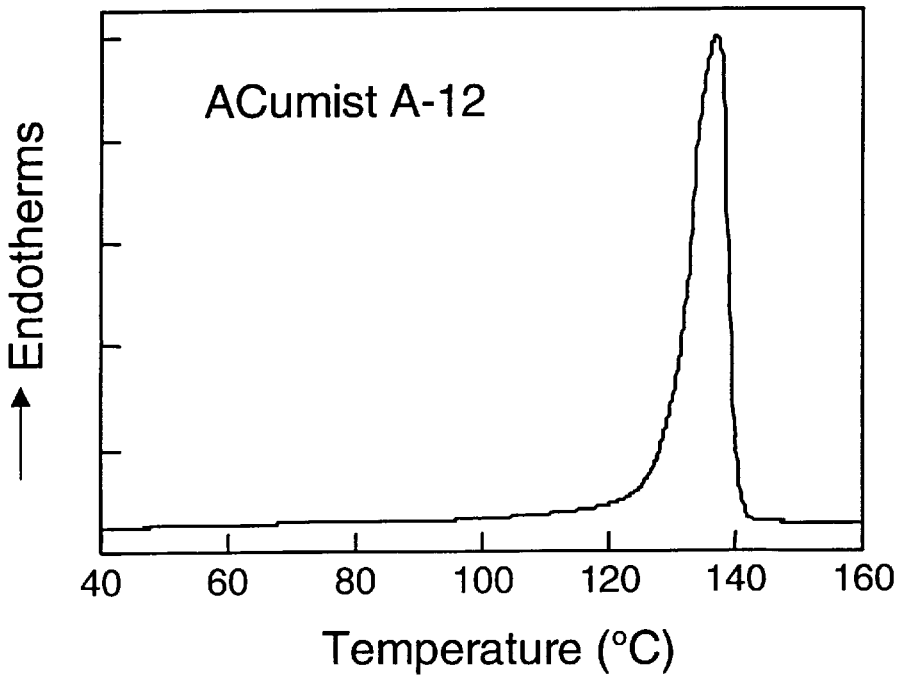

In accordance with the present invention, the improved polyethylene lubricant is a high density polyethylene, having mainly linear macromolecular chains. For the purposes of the invention, the polyethylene has a weight-average molecular weight MW between 2,000 and 50,000, preferably between 5,000 and 20,000, and it has a sharp melting point, determined from differential scanning calorimetry, between 120 and 140° C., preferably between 130 and 140° C. The polyethylene lubricant of the invention concerns both high density polyethylene having typically a density of 0.95–0.97 g/cc and slightly oxidized high density polyethylene having typically a density of 0.98–1.00 g/cc and an acid number up to 100 mg KOH/g. Typically, the polyethylene lubricant described in this invention is different from the low density and low molecular weight branched-polyethylene waxes used thus far, which have a broad melting temperature ranging mainly between 60 and 120° C. (FIGS. 1 and 2). The high melting temperature of the high density polyethylene compared to the low density polyethylene may be explained by the good molecular symmetry of the linear chains which lead to a high crystalline arrangement and a high molecular cohesion. It is believed that the good lubrication observed during either the compaction and the ejection of the powder compositions of the invention is due in particular to the high linearity of the macromolecular chains which are able to slide one on the other when submitted to the high pressure used in the P/M processes. Commercially available high-density polyethylenes, suitable as P/M lubricant in accordance with the present invention, are for example the high density polyethylene PE-190 from Clariant, and the slightly oxidized high density polyethylene ACumist A-12 from Allied Signal Inc. These high density polyethylenes have been used thus far in the plastics industry as external lubricants for thermoplastic compounds and processes, as for PVC, but have not yet been proposed as lubricants for P/M applications.

The powder compositions of the invention can be compacted using conventional powder metallurgy conditions. The compacting pressures are typically lower than 85 tsi and more specifically between 10 and 60 tsi. For warm compaction, the die temperature suitable with the compositions of the invention is below about 200° C., preferably below 150° C., and more preferably between 115 and 130° C.

EXAMPLES

Example 1

Two different types of polyethylene were tested as lubricants of the invention in comparison with a conventional lubricant, N,N'-ethylenebis(stearamide) wax (EBS). Using conventional dry-mixing blenders, three different powder mixtures were prepared containing 98.65 wt % ATOMET 1001 steel powder (Quebec Metal Powders Ltd.), 0.6 wt % graphite powder (South Western 1651) and 0.75 wt % of these three different lubricants. The first polyethylene was a (low-density) polyethylene wax lubricant CERACER 640, commercially available from Shamrock Technologies. The second polyethylene used as lubricant was the oxidized high density polyethylene ACumist A-12 from Allied Signal Inc, having an acid number of 30 mg KOH/g. The weight-average molecular weights of CERACER 640 and ACumist A-12 determined by size exclusion chromatography are 1,492 and 10,201 respectively. The third lubricant was the atomized ACRAWAX C from Lonza Inc. (EBS).

Transverse rupture strength (TRS) bars (3.175×1.270×0.635 cm) were compacted at 65° C. and 45 tsi in a floating compaction die, and ejection pressures were recorded for each mixture. Due to the high production rates of metal powder parts encountered in the P/M industry, the die temperature normally increases, then stabilizes, due to the friction between the parts and die walls during the compaction and ejection cycle. A die temperature of 65° C. was chosen to take into account this rise of die temperature. Densities and mechanical strengths (transverse rupture strength according to MPIF 15 Standard) were evaluated. Results are compared in Table 1.

Figure 3A:
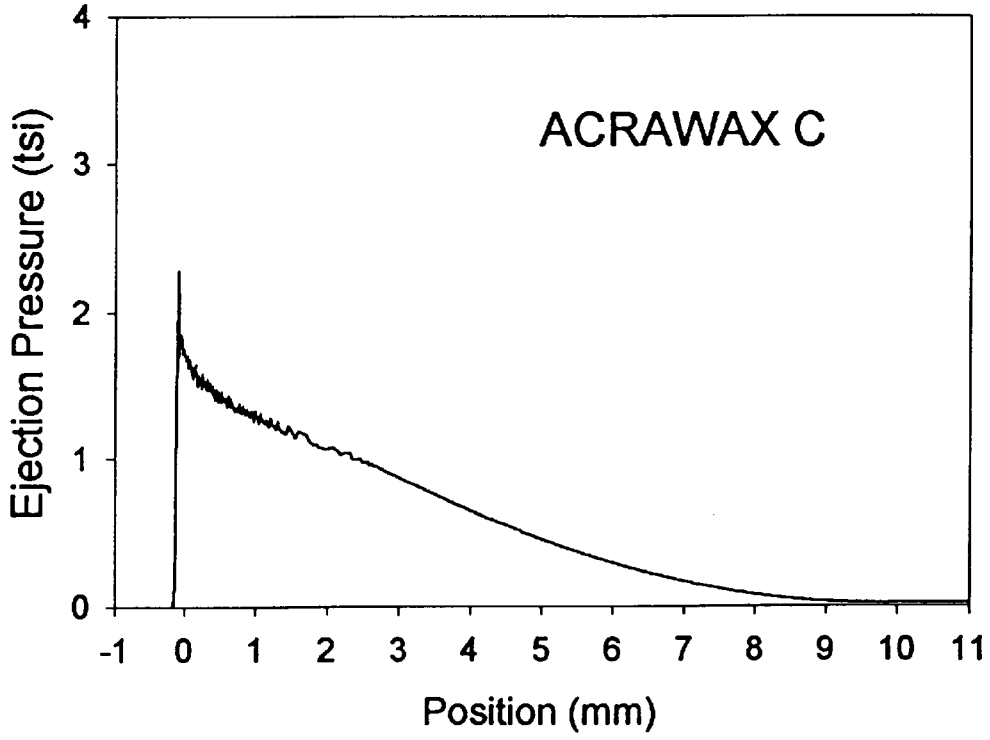
FIGS. 3*a*–3*c* illustrate ejection curves of powder compositions lubricated with, respectively, ACRAWAX C, CERACER 640 and Acumist A-12, compacted at 45 tsi and 65° C.
Figure 3B:
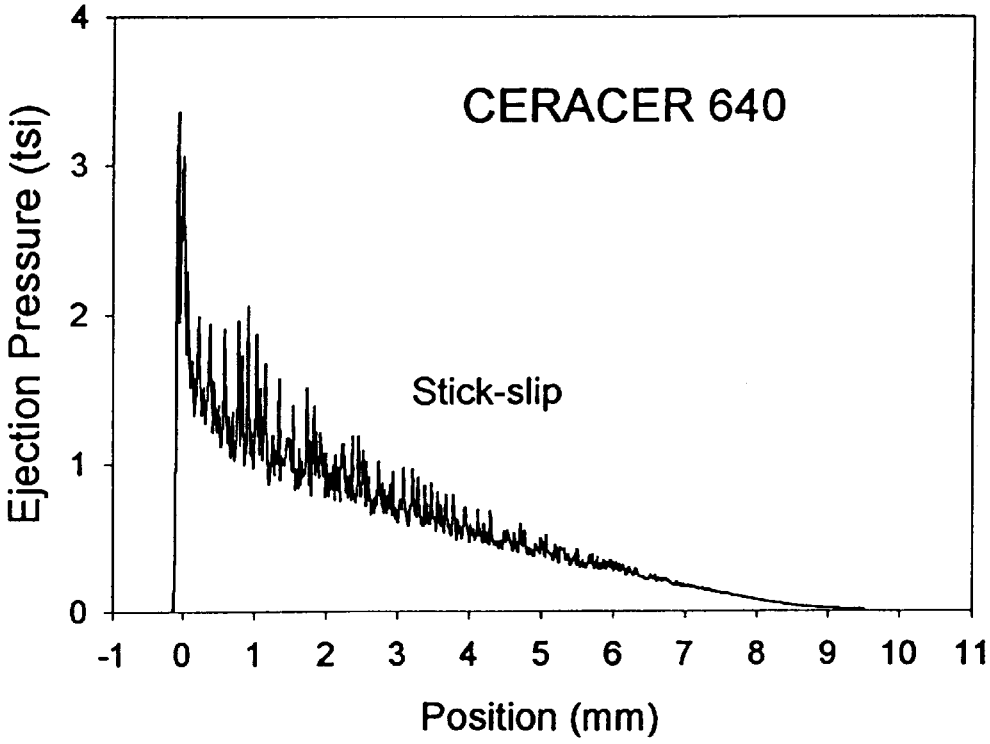
Figure 3C:
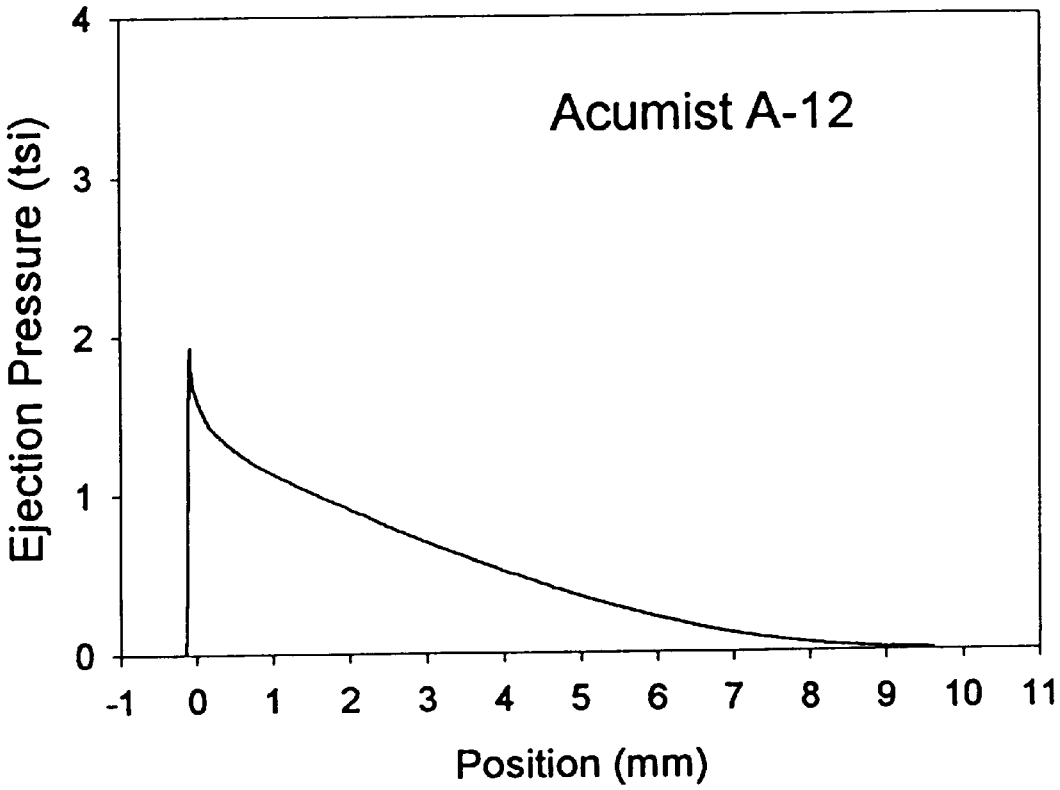

The compaction and ejection characteristics of the three mixtures were also evaluated with an instrumented compacting die, known as the Powder Testing Center Model PTC 03DT, manufactured by KZK Powder Technologies Corporation, Cleveland, Ohio. Cylindrical specimens of 9.5 mm diameter and 8.0 mm height were pressed at 45 tsi and 65° C. in a single action compacting die made of H13-steel. The aspect ratio of the cylinder is closer to parts commonly manufactured than the aspect ratio of TRS bars. For each experiment, the effectiveness of the compaction was evaluated from the green density and from the slide coefficient $\eta$. This coefficient characterizes the ability of the powder mix to transfer efficiently the pressure applied from the bottom punch to the top punch. Its numerical value varies between 0 and 1, $\eta=0$ representing no sliding at die walls, and $\eta=1$ representing perfect sliding with no friction at die walls. Thus, the higher the slide coefficient, the better the lubrication at die walls during the compaction. During the ejection process, continuous recording of the force required to eject the specimen out of the die allows the determination of the stripping pressure and the evaluation of the lubrication behavior during the ejection of parts. The stripping pressure corresponds to the force needed to start the ejection process divided by the friction area. PTC results are compared in Table 2 and FIG. 3.

TABLE 1

Results for TRS bars, compacted at 45 tsi and 65° C.

| Lubricant | ACRAWAX C | CERACER 640 | ACumist A-12 |
|---|---|---|---|
| Green density, g/cm$^3$ | 7.12 | 7.11 | 7.09 |
| Stripping pressure (Ejection peak), tsi | 2.75 | 2.91* | 2.23 |
| Green TRS, psi | 2004 | 3173 | 3261 |

*high level of noise during ejection due to high level of stick-slip

TABLE 2

Results for PTC cylindrical specimens, compacted at 45 tsi and 65° C.

| Lubricant | ACRAWAX C | CERACER 640 | ACumist A-12 |
|---|---|---|---|
| Green density, g/cm$^3$ | 7.11 | 7.06 | 7.10 |
| Slide coefficient | 0.66 | 0.61 | 0.71 |
| Stripping pressure (Ejection peak), tsi | 2.43 | 3.23 | 1.97 |

It has been found in the cold compaction tests that compacts using the HD polyethylene lubricant of the invention (ACumist A-12), had similar density as compacts obtained with conventional EBS lubricant (ACRAWAX C) but higher green strength (3261 psi vs 2004 psi) and better lubrication during compaction and ejection of parts (slide coefficient 0.71 vs 0.66, and smooth ejection curve). TRS bars produced using the LD polyethylene wax lubricant CERACER 640 described in the prior art, had similar densities and green strengths as those produced with the ACumist A-12 lubricant. PTC results show however that the value of slide coefficient is higher for ACumist A-12 (0.71 vs 0.61), which corresponds to a higher level of friction at die walls for the CERACER 640 lubricated compositions. Depending on the geometry and the complexity of the parts, this can influence the resulting green densities. Effectively, with the CERACER 640 lubricated compositions, the density of PTC parts, which have a higher aspect ratio than TRS bars, is slightly lower than the density of the ACumist A-12 lubricated compositions (7.06 vs 7.10 g/cc). Besides, the low density and low molecular weight branched-polyethylene wax CERACER 640 gives rise to a worse lubrication behavior during the ejection of compacted parts from the die, as can be seen on the ejection curve (FIG. 3) with the high level of stick-slip phenomena. This is in agreement with the same observation made by Klemm et al. (1993) paper referred to in the Background of the Invention.

Example 2

A high density polyethylene lubricant was tested in comparison with a conventional lubricant, a N,N'-ethylenebis (stearamide) wax (EBS), and a known lubricant for warm compaction, which is a mixture of amide waxes and polyamides. Using conventional dry-mixing blenders, three different powder mixtures were prepared containing 98.65 wt % ATOMET 1001 steel powder (Quebec Metal Powders Ltd.), 0.6 wt % graphite powder (South Western 1651) and 0.75 wt % of the three lubricants. The first, a polyethylene lubricant, was the slightly oxidized high density polyethylene ACumist A-12 from Allied Signal Inc. The second, EBS lubricant, was the atomized ACRAWAX C from Lonza Inc. The third lubricant was a polyamide lubricant PROMOLD 450 available from Morton International of Cincinnati, Ohio.

Transverse rupture strength (TRS) bars (3.175×1.270×0.635 cm) were compacted at 130° C. and 45 tsi in a floating compaction die, and ejection pressures were recorded for each mixture. Densities and mechanical strengths (transverse rupture strength according to MPIF 15 Standard) were evaluated. Results are compared in Table 3.

TABLE 3

Results for TRS bars, compacted at 45 tsi and 130° C.

| Lubricant | ACRAWAX C | PROMOLD 450 | ACumist A-12 |
|---|---|---|---|
| Green density, g/cc | 7.21 | 7.24 | 7.24 |
| Stripping pressure (Ejection peak), tsi | 2.09 | 2.28 | 1.85 |
| Green TRS, psi | 2608 | 3058 | 5645 |

Unlike commercially available P/M polyethylene lubricants, this example shows that the improved polyethylene lubricant of the invention (ACumist A-12) maintains excellent lubricating properties when the compaction temperature increases and can thus be used favourably for warm compaction applications. Indeed, a low stripping pressure was measured during the ejection of the parts from the die, and parts with a good surface finish were obtained. Besides, polyethylene-lubricated ferrous powder compositions of the invention enable the manufacture by warm compaction of parts having high densities and high green strengths, higher than those expected, compared to ACRAWAX C and PROMOLD 450 lubricants.

Example 3

The following FLOMET FN-0205 powder composition was prepared by dry-mixing in a rotating blender 96.3 wt % ATOMET 1001 steel powder (Quebec Metal Powders Ltd.), 2.5 wt % nickel powder (Inco 123 from Inco Ltd.), 0.6 wt % graphite powder (KS15) (Timcal America Inc.), 0.55 wt % of oxidized high density polyethylene (ACumist A-12 from Allied Signal Inc) and 0.05 wt % of lithium 12-hydroxy stearate (from H.L. Blachford Ltd.). A small amount of binder (0.03 wt % of polyvinylpyrrolidone K-30 from ISP Inc.) dissolved in 1.4 wt % of methanol was then sprayed on the dry mixture while the blender was still rotating. The solvent was then evaporated under vacuum while heating the blender shell. This procedure desirably binds the fine metal, alloying and solid lubricants particles to the metal particles.

The flow rate and the apparent density were measured with a Hall flowmeter according to MPIF Standards 03 and 04. Transverse rupture strength (TRS) bars (3.175×1.270×0.635 cm) were compacted at 130° C. and 50 tsi in a floating compaction die. Densities and mechanical strengths (transverse rupture strength were evaluated according to MPIF Standard 15). Results are cited in Table 4.

TABLE 4

| | |
|---|---|
| Flow rate, s/50 g | 27.5 |
| Apparent density, g/cc | 2.99 |
| Green density, g/cc | 7.33 |
| TRS, psi | 6540 |

Those skilled in the art will note the good flowability and the apparent density of the FLOMET powder composition of the invention. After compaction, green parts with high densities and a good surface finish were obtained. Besides, at a relatively low warm-compaction temperature used, the parts exhibited a surprisingly high mechanical strength with a TRS value higher than 6000 psi. This example shows a good processability and high green compact properties obtained with the described binder-treated mix comprising the polyethylene lubricant of the invention.

In summary, using the ferrous powder compositions of the invention comprising an improved polyethylene lubricant, as compared to the commercially available P/M polyethylene lubricants, significantly better lubrication was observed during the cold compaction and ejection of parts, while producing parts having similar density and green strength. Besides, unlike commercially available P/M polyethylene lubricants, the improved polyethylene lubricants of the invention maintain their excellent lubrication properties when the compaction temperature increases and can thus be also used for warm compaction applications. Effectively, polyethylene-lubricated ferrous powder compositions of the invention enable the manufacture by warm compaction of parts having high densities and surprisingly high green strengths, together with low ejection forces and good surface finishes.

The above examples use ferrous powder compositions. It is however reasonable to conclude, considering the melting temperature of high-density polyethylene and the properties of various metals, that the lubricant proposed herein is applicable for other metal powder compositions, the metal being one or more of the metals typically used in powder metallurgy.

What is claimed is:

1. A metal powder composition for cold and warm pressing, comprising a ferrous powder and from 0.1 to about 3 wt % of a high-density polyethylene lubricant based on the total weight of the composition, said polyethylene lubricant having a weight-average molecular weight between 2,000 and 50,000 and a melting point between 120 and 140° C.

2. The composition according to claim 1 wherein the content of said lubricant is from about 0.2 wt. % to about 1.5 wt. %.

3. The composition according to claim 1 wherein said lubricant is admixed to the metal powder in a comminuted solid state.

4. The composition according to claim 1 further comprising alloying powders in the amount of less than 15 weight percent of said composition.

5. The composition according to claim 1 wherein said polyethylene lubricant has a weight-average molecular weight between 5,000 and 20,000, and a melting point between 130 and 140° C.

6. The composition according to claim 1 wherein said lubricant is admixed to the metal powder in the form of an emulsion or a solution.

7. The composition according to claim 1 wherein said lubricant is admixed to the metal powder in a molten state.

8. The composition according to claim 1 further comprising one or more additives selected from the group consisting of binders and solid lubricants.

* * * * *